US012704330B2

(12) United States Patent
Bergman et al.

(10) Patent No.: US 12,704,330 B2
(45) Date of Patent: Aug. 11, 2026

(54) AIRCRAFT HEAT EXCHANGERS AND PLATES

(71) Applicant: RTX Corporation, Farmington, CT (US)

(72) Inventors: Russell J. Bergman, South Windsor, CT (US); William D. Blickenstaff, Port Saint Lucie, FL (US); James F. Wiedenhoefer, Windsor, CT (US); Scott D. Virkler, Ellington, CT (US); Jason D. Liles, Palmyra, VA (US)

(73) Assignee: RTX Corporation, Farmington, CT (US)

( * ) Notice: Subject to any disclaimer, the term of this patent is extended or adjusted under 35 U.S.C. 154(b) by 484 days.

(21) Appl. No.: 18/141,697

(22) Filed: May 1, 2023

(65) Prior Publication Data

US 2023/0296331 A1 Sep. 21, 2023

Related U.S. Application Data

(62) Division of application No. 17/124,790, filed on Dec. 17, 2020, now Pat. No. 11,674,758.
(Continued)

(51) Int. Cl.
*F28F 3/12* (2006.01)
*F28D 9/00* (2006.01)
(Continued)

(52) U.S. Cl.
CPC ..... *F28F 3/12* (2013.01); *F28D 9/0081* (2013.01); *F28F 9/0202* (2013.01);
(Continued)

(58) Field of Classification Search
CPC .. F02K 3/115; F02C 7/185; F02C 7/16; F28F 3/12; F28F 9/0263; F28F 2009/029;
(Continued)

(56) References Cited

U.S. PATENT DOCUMENTS 3,552,488 A 1/1971 Grill et al.
4,137,705 A 2/1979 Anderson et al.
(Continued)

FOREIGN PATENT DOCUMENTS

CN 108869044 A 11/2018
CN 110553533 A 12/2019
(Continued)

OTHER PUBLICATIONS

European Office Action dated Jul. 30, 2024 for European Patent Application No. 20218011.3.
(Continued)

*Primary Examiner* — Paul Alvare
(74) *Attorney, Agent, or Firm* — Bachman & LaPointe, P.C.

(57) ABSTRACT

A heat exchanger plate for provides heat transfer between a first flow along a first flowpath and a second flow along a second flowpath. The heat exchanger plate comprised a body having: a first face and a second face opposite the first face; a leading edge along the second flowpath and a trailing edge along the second flowpath; a proximal edge having at least one inlet port along the first flowpath and at least one outlet port along the first flowpath; and at least one passageway along the first flowpath. Along a proximal portion, the first face and the second face converge at a first angle. Along a distal portion, the first face and the second face converge at a second angle less than the first angle.

20 Claims, 11 Drawing Sheets

Related U.S. Application Data

(60) Provisional application No. 62/963,070, filed on Jan. 19, 2020.

(51) Int. Cl.
*F28F 9/02* (2006.01)
*F28F 13/08* (2006.01)

(52) U.S. Cl.
CPC ..... *F28D 9/0018* (2013.01); *F28F 9/0263* (2013.01); *F28F 2009/029* (2013.01); *F28F 13/08* (2013.01)

(58) Field of Classification Search
CPC ..... F28F 13/08; F28D 9/0081; F28D 9/0018; F05D 2260/22141
See application file for complete search history.

(56) References Cited

U.S. PATENT DOCUMENTS 4,438,809 A 3/1984 Papis
4,520,868 A 6/1985 Grawey
4,574,872 A * 3/1986 Yano ..... F28D 19/04 165/DIG. 18
4,715,431 A 12/1987 Schwarz et al.
4,813,112 A 3/1989 Pilliez
5,009,263 A 4/1991 Seshimo et al.
5,107,922 A 4/1992 So
5,318,114 A 6/1994 Sasaki
5,417,280 A 5/1995 Hayashi et al.
5,443,116 A 8/1995 Hayashi et al.
5,517,757 A 5/1996 Hayashi et al.
5,531,268 A 7/1996 Hoshino et al.
5,718,127 A 2/1998 Aitken
6,134,880 A 10/2000 Yoshinaka
6,328,100 B1 12/2001 Haussmann
6,357,113 B1 3/2002 Williams
6,430,931 B1 8/2002 Horner
6,564,863 B1 5/2003 Martins
6,607,026 B1 8/2003 Naji et al.
6,945,320 B2 9/2005 Harvard, Jr. et al.
6,966,173 B2 11/2005 Dewis
7,147,050 B2 * 12/2006 Kang ..... F28F 3/025 165/170
7,334,411 B2 2/2008 Vandermolen
7,669,645 B2 3/2010 Nakamura
7,770,633 B2 8/2010 Miyahara
7,784,528 B2 8/2010 Ottow et al.
7,861,512 B2 1/2011 Olver et al.
7,950,149 B2 5/2011 Golecki
8,181,443 B2 5/2012 Rago
8,266,888 B2 9/2012 Liu
8,387,362 B2 3/2013 Storage et al.
8,438,835 B2 5/2013 Perveiler et al.
8,573,291 B2 11/2013 Vick
8,656,988 B1 2/2014 Paul et al.
8,689,547 B2 4/2014 Burgers et al.
8,770,269 B2 7/2014 Scott
8,784,047 B2 7/2014 Elder
9,200,855 B2 12/2015 Kington et al.
9,243,563 B2 1/2016 Lo
9,328,968 B2 5/2016 Vanderwees
9,377,250 B2 6/2016 Landre
9,732,702 B2 8/2017 Ueda
9,752,803 B2 9/2017 Matter et al.
9,766,019 B2 9/2017 Eleftheriou et al.
9,771,867 B2 9/2017 Karam et al.
9,816,766 B2 11/2017 Miller et al.
9,835,043 B2 12/2017 Kantany et al.
9,851,159 B2 12/2017 Cameron
9,909,812 B2 3/2018 Peskos et al.
9,982,630 B2 5/2018 Marini et al.
10,041,741 B2 8/2018 Turcotte et al.
10,100,740 B2 10/2018 Thomas
10,125,684 B2 11/2018 Yu
10,175,003 B2 1/2019 Sennoun et al.
10,184,400 B2 1/2019 Cerny et al.
10,208,621 B2 2/2019 Hoefler et al.
10,222,142 B2 3/2019 Alvarez et al.
10,316,750 B2 6/2019 Loebig et al.
10,422,585 B2 9/2019 Jensen et al.
10,480,407 B2 11/2019 Alecu
10,830,540 B2 11/2020 Sennoun et al.
10,926,364 B2 2/2021 Thresher
11,219,841 B2 1/2022 Wan et al.
2001/0018024 A1 8/2001 Hyde et al.
2002/0124569 A1* 9/2002 Treece ..... F28D 9/0018 60/39.511
2004/0026072 A1 2/2004 Yi et al.
2004/0040153 A1 3/2004 Ashida et al.
2004/0050531 A1 3/2004 Horiuchi et al.
2004/0100771 A1* 5/2004 Luo ..... F28D 15/02 165/104.33
2004/0111829 A1 6/2004 Bruno et al.
2006/0225867 A1* 10/2006 Park ..... F28F 9/0263 165/170
2008/0283234 A1 11/2008 Sagi et al.
2009/0169359 A1 7/2009 Murphy et al.
2009/0218156 A1* 9/2009 Walser ..... B62J 25/04 165/44
2010/0084120 A1 4/2010 Yin et al.
2010/0108297 A1* 5/2010 Chen ..... F28D 15/0233 29/890.032
2010/0170262 A1 7/2010 Kaslusky et al.
2011/0088405 A1 4/2011 Turco
2011/0146944 A1 6/2011 Hand et al.
2011/0168366 A1 7/2011 Garret et al.
2013/0199152 A1 8/2013 Menheere et al.
2013/0199288 A1* 8/2013 Goenka ..... F28F 9/0263 73/202
2013/0213623 A1 8/2013 Perocchio et al.
2014/0246179 A1 9/2014 Vallee et al.
2014/0318751 A1 10/2014 Kinder et al.
2015/0047818 A1 2/2015 Peskos et al.
2015/0047820 A1 2/2015 Rhoden
2016/0069266 A1 3/2016 Murphy et al.
2016/0123230 A1* 5/2016 Thomas ..... F02K 3/115 60/39.83
2016/0177828 A1 6/2016 Snyder et al.
2016/0230669 A1 8/2016 Selstad et al.
2016/0265850 A1 9/2016 Kupiszewski et al.
2016/0362999 A1 12/2016 Ho
2017/0009703 A1 1/2017 Moon et al.
2017/0184024 A1 6/2017 Sennoun
2017/0363361 A1 12/2017 Turney
2018/0051935 A1 2/2018 Roberge
2018/0058472 A1 3/2018 Tajiri et al.
2018/0172368 A1 6/2018 Kowalski et al.
2018/0238238 A1 8/2018 Luschek et al.
2018/0238630 A1 8/2018 Pollard et al.
2018/0244127 A1* 8/2018 Sennoun ..... F28F 7/02
2018/0245853 A1 8/2018 Sennoun et al.
2018/0258859 A1 9/2018 Suciu et al.
2018/0292140 A1 10/2018 Mayo et al.
2018/0328285 A1 11/2018 Tajiri et al.
2019/0154345 A1 5/2019 Martinez et al.
2019/0170445 A1 6/2019 McCaffrey
2019/0170455 A1 6/2019 McCaffrey
2019/0204012 A1 7/2019 Army et al.
2019/0212074 A1 7/2019 Lockwood et al.
2019/0234690 A1 8/2019 Sobolak et al.
2019/0277571 A1 9/2019 Disori et al.
2019/0277579 A1 9/2019 Disori et al.
2019/0293365 A1 9/2019 Disori et al.
2019/0293366 A1 9/2019 Disori et al.
2019/0310030 A1 10/2019 Disori et al.
2019/0339012 A1 11/2019 Disori et al.
2020/0189046 A1 6/2020 Ravindranath et al.
2020/0347737 A1* 11/2020 Bordoni ..... F01D 5/187
2020/0395890 A1 12/2020 Hutting et al.
2021/0054787 A1* 2/2021 Ueda ..... F02K 3/115
2021/0207535 A1 7/2021 Bergman et al.
2021/0222624 A1 7/2021 Wiedenhoefer et al.

(56) References Cited

U.S. PATENT DOCUMENTS

| | | | |
|---|---|---|---|
| 2021/0222962 | A1 | 7/2021 | Wiedenhoefer et al. |
| 2021/0285375 | A1 | 9/2021 | Wiedenhoefer et al. |
| 2021/0318071 | A1 | 10/2021 | Hart et al. |

FOREIGN PATENT DOCUMENTS

| | | | | | |
|---|---|---|---|---|---|
| DE | 9309822 | U1 | | 11/1994 | |
| DE | 19515528 | A1 | | 10/1996 | |
| DE | 102008051422 | A1 | | 4/2010 | |
| EP | 656517 | A1 | | 11/1994 | |
| FR | 2770632 | A1 | | 5/1999 | |
| FR | 3075870 | A1 | | 6/2019 | |
| GB | 574450 | A | | 1/1946 | |
| GB | 2343641 | A | * | 5/2000 | ..... F28D 9/0018 |
| IN | 101309577 | A | | 11/2008 | |
| JP | H0961084 | A | | 3/1997 | |
| JP | H11148793 | A | | 6/1999 | |
| WO | 2021/138307 | A1 | | 7/2021 | |
| WO | 2021/146674 | A1 | | 7/2021 | |

OTHER PUBLICATIONS

US Office Action dated Jul. 6, 2023 for U.S. Appl. No. 17/125,214.
Chris Wiegand et al., "F-35 Air Vehicle Technology Overview", Aviation Technology, Integration, and Operations Conference, Jun. 2018, American Institute of Aeronautics and Astronautics, Inc., Reston, Virginia.
Jonathan Lowell, "Keeping Cool over Salt Lake", Aug. 25, 2019, US Air Force, Washington, DC, retrieved from Internet Nov. 9, 2019 https://www.af.mil/News/Commentaries/Display/Article/1941943/keeping-cool-over-salt-lake/.
Sean Robert Nuzum, Thesis: "Aircraft Thermal Management using Liquefied Natural Gas", Apr. 27, 2016, Wright State University, Dayton, Ohio.
US Office Action dated Nov. 9, 2021 for U.S. Appl. No. 17/139,174.
European Search Report and Opinion dated Oct. 20, 2021 for European Patent Application No. 20218011.3.
US Office Action dated Apr. 26, 2022 for U.S. Appl. No. 17/137,946.
International Search Report and Written Opinion dated Mar. 31, 2021 for PCT/US21/13804.
European Search Report dated Feb. 7, 2022 for European Patent Application No. 21740964.8 (EP stage of PCT/US2021/013804-WO/2021/146674).
US Office Action dated Dec. 13, 2021 for U.S. Appl. No. 17/124,551.
International Search Report and Written Opinion dated Mar. 19, 2021 for PCT/US20/67289.
European Search Report dated Nov. 25, 2021 for European Patent Application No. 20910078.3 (EP stage of PCT/US2020/067289-WO/2021/138307).
European Search Report dated Nov. 19, 2021 for European Patent Application No. 21191780.2 (divisional of EP stage of PCT/US2020/067289-WO/2021/138307).
Extended European Search Report dated Mar. 31, 2022 for European Patent Application No. 20910078.3 (EP stage pf PCT/US20/67289-WO/2021/138307).
Extended European Search Report dated Mar. 31, 2022 for European Patent Application No. 21191780.2 (EP divisional of PCT/US20/67289-WO/2021/138307).
European Office Action dated Sep. 27, 2023 for European Patent Application No. 21191780.2.

* cited by examiner

AIRCRAFT HEAT EXCHANGERS AND PLATES

CROSS-REFERENCE TO RELATED APPLICATION

This is a divisional of U.S. patent application Ser. No. 17/124,790, filed Dec. 17, 2020, and entitled "Aircraft Heat Exchangers and Plates", now U.S. Pat. No. 11,674,758, which claims benefit of U.S. Patent Application No. 62/963,070, filed Jan. 19, 2020, and entitled "Aircraft Heat Exchangers and Plates", the disclosure of which is incorporated by reference herein in its entirety as if set forth at length.

BACKGROUND

The disclosure relates to gas turbine engine heat exchangers. More particularly, the disclosure relates to air-to-air heat exchangers.

Examples of gas turbine engine heat exchangers are found in: United States Patent Application Publication 20190170445A1 (the '445 publication), McCaffrey, Jun. 6, 2019, "HIGH TEMPERATURE PLATE FIN HEAT EXCHANGER"; United States Patent Application Publication 20190170455A1 (the '455 publication), McCaffrey, Jun. 6, 2019, "HEAT EXCHANGER BELL MOUTH INLET"; and United States Patent Application Publication 20190212074A1 (the '074 publication), Lockwood et al., Jul. 11, 2019, "METHOD FOR MANUFACTURING A CURVED HEAT EXCHANGER USING WEDGE SHAPED SEGMENTS", the disclosures of which three publications are incorporated by reference in their entireties herein as if set forth at length.

An exemplary positioning of such a heat exchanger provides for the transfer of thermal energy from a flow (heat donor flow) diverted from an engine core flow to a bypass flow (heat recipient flow). For example, air is often diverted from the compressor for purposes such as cooling. However, the act of compression heats the air and reduces its cooling effectiveness. Accordingly, the diverted air may be cooled in the heat exchanger to render it more suitable for cooling or other purposes. One particular example draws the heat donor airflow from a diffuser case downstream of the last compressor stage upstream of the combustor. This donor flow transfers heat to a recipient flow which is a portion of the bypass flow. To this end, the heat exchanger may be positioned within a fan duct or other bypass duct. The cooled donor flow is then returned to the engine core (e.g., radially inward through struts) to pass radially inward of the gas path and then be passed rearward for turbine section cooling including the cooling of turbine blades and vanes. The heat exchanger may conform to the bypass duct. The bypass duct is generally annular. Thus, the heat exchanger may occupy a sector of the annulus up to the full annulus.

Other heat exchangers may carry different fluids and be in different locations. For example, instead of rejecting heat to an air flow in a bypass duct, other heat exchangers may absorb heat from a core flow (e.g., as in recuperator use). Among further uses for heat exchangers in aircraft are power and thermal management systems (PTMS) also known as integrated power packages (IPP). One example is disclosed in United States Patent Application publication 20100170262A1, Kaslusky et al., Jul. 8, 2010, "AIRCRAFT POWER AND THERMAL MANAGEMENT SYSTEM WITH ELECTRIC CO-GENERATION". Another example is disclosed in United States Patent Application publication 20160362999A1, Ho, Dec. 15, 2016, "EFFICIENT POWER AND THERMAL MANAGEMENT SYSTEM FOR HIGH PERFORMANCE AIRCRAFT". Another example is disclosed in United States Patent Application publication 20160177828A1, Snyder et al., Jun. 23, 2016, "STAGED HEAT EXCHANGERS FOR MULTI-BYPASS STREAM GAS TURBINE ENGINES".

U.S. Pat. No. 10,100,740 (the '740 patent, the disclosure of which is incorporated by reference in its entirety herein as if set forth at length), to Thomas, Oct. 16, 2018, "Curved plate/fin heater exchanger", shows attachment of a square wave form fin array to the side of a heat exchanger plate body. For plates in a radial array, the wave amplitude progressively increases to accommodate a similar increase in inter-plate spacing.

SUMMARY

One aspect of the disclosure involves a heat exchanger for providing heat transfer between a first flow along a first flowpath and a second flow along an arcuate second flowpath. The heat exchanger has: an inlet manifold having at least one inlet port and at least one outlet port; an outlet manifold having at least one outlet port and at least one inlet port; and at least one plate bank. The at least one plate bank has a plurality of plates, each plate comprising a body mounted to the inlet manifold and the outlet manifold and having: at least one inlet port along the first flowpath and at least one outlet port along the first flowpath; a first face and a second face opposite the first face; a leading edge along the second flowpath and a trailing edge along the second flowpath; an inner diameter edge; and an outer diameter edge, a thickness of the body between the first face and second face tapering along a first region in an inward radial direction from the outer diameter edge to the inner diameter edge. The plate bank includes fin arrays between adjacent said plates spanning between the first face in the first region of one said plate and the second face in the first region of the other said plate, the fin arrays each formed by a wave form sheet metal piece having essentially uniform wave amplitude.

In a further embodiment of any of the foregoing embodiments, additionally and/or alternatively, for each plate of the plurality of plates the at least one inlet port and at least one outlet port are along one of the inner diameter edge and the outer diameter edge.

In a further embodiment of any of the foregoing embodiments, additionally and/or alternatively, for each plate of the plurality of plates the inlet manifold and outlet manifold are portions of a combined manifold structure.

In a further embodiment of any of the foregoing embodiments, additionally and/or alternatively, the combined manifold structure is arcuate having a concave inner diameter face, the plates mounted to the inner diameter face.

In a further embodiment of any of the foregoing embodiments, additionally and/or alternatively, for each plate of the plurality of plates the at least one inlet port and at least one outlet port are along the outer diameter edge.

In a further embodiment of any of the foregoing embodiments, additionally and/or alternatively, for each plate of the plurality of plates, the at least one inlet port and at least one outlet port are along the outer diameter edge.

Another aspect of the disclosure involves a gas turbine engine including the heat exchanger of any of the foregoing embodiments and further comprising a bypass flowpath forming the second flowpath.

Another aspect of the disclosure involves a method for using the heat exchanger of any of the foregoing embodiments. The method comprises: passing the first flow along the first flowpath; and passing the second flow along the second flowpath to transfer said heat from the first flow to the second flow.

In a further embodiment of any of the foregoing embodiments, additionally and/or alternatively, the second flow passes along the plate first faces and plate second faces.

Another aspect of the disclosure involves a heat exchanger plate for providing heat transfer between a first flow along a first flowpath and a second flow along a second flowpath. The heat exchanger plate comprises a body having: a first face and a second face opposite the first face; a leading edge along the second flowpath and a trailing edge along the second flowpath; a proximal edge having at least one inlet port along the first flowpath and at least one outlet port along the first flowpath; and at least one passageway along the first flowpath. Along at least 8.0% of a height between the proximal edge and the distal edge, the first face and the second face converge at a first angle of at least 0.25°.

In a further embodiment of any of the foregoing embodiments, additionally and/or alternatively, said at least 8.0% of a height between the proximal edge and the distal edge is a continuous zone and the first angle is uniform along said continuous zone.

In a further embodiment of any of the foregoing embodiments, additionally and/or alternatively, the plate has a plurality of interior walls separating legs of the at least one passageway at a progressively increasing spacing from proximal to distal.

In a further embodiment of any of the foregoing embodiments, additionally and/or alternatively, along at least 50% of a height between the proximal edge and the distal edge, the first face and the second face converge at a first angle of between 0.25° and 5.0°.

In a further embodiment of any of the foregoing embodiments, additionally and/or alternatively, the passageway comprises: an inlet plenum extending from the at least one inlet port of the plate; an outlet plenum extending to the at least one outlet port of the plate; and a plurality of legs in parallel between the inlet plenum and the outlet plenum.

In a further embodiment of any of the foregoing embodiments, additionally and/or alternatively: the inlet plenum is adjacent the trailing edge; and the outlet plenum is adjacent the leading edge.

Another aspect of the disclosure involves a heat exchanger plate for providing heat transfer between a first flow along a first flowpath and a second flow along a second flowpath. The heat exchanger plate comprised a body having: a first face and a second face opposite the first face; a leading edge along the second flowpath and a trailing edge along the second flowpath; a proximal edge having at least one inlet port along the first flowpath and at least one outlet port along the first flowpath; and at least one passageway along the first flowpath. Along a proximal portion, the first face and the second face converge at a first angle. Along a distal portion, the first face and the second face converge at a second angle less than the first angle.

In a further embodiment of any of the foregoing embodiments, additionally and/or alternatively: along the proximal portion, the body has integral fins; and along the distal portion, the plate has sheetmetal fins secured to the body.

In a further embodiment of any of the foregoing embodiments, additionally and/or alternatively, the first angle is at least 0.25° greater than the second angle.

In a further embodiment of any of the foregoing embodiments, additionally and/or alternatively, the second angle is 0.0°.

In a further embodiment of any of the foregoing embodiments, additionally and/or alternatively, the proximal portion extends for a height of at least 8% of a height from the proximal edge.

In a further embodiment of any of the foregoing embodiments, additionally and/or alternatively, along the proximal portion, the plate has a plurality of walls at a progressively increasing spacing from proximal to distal.

In a further embodiment of any of the foregoing embodiments, additionally and/or alternatively, along the distal portion, the plate has a plurality of walls at a constant spacing.

In a further embodiment of any of the foregoing embodiments, additionally and/or alternatively, the body comprises a cast substrate.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
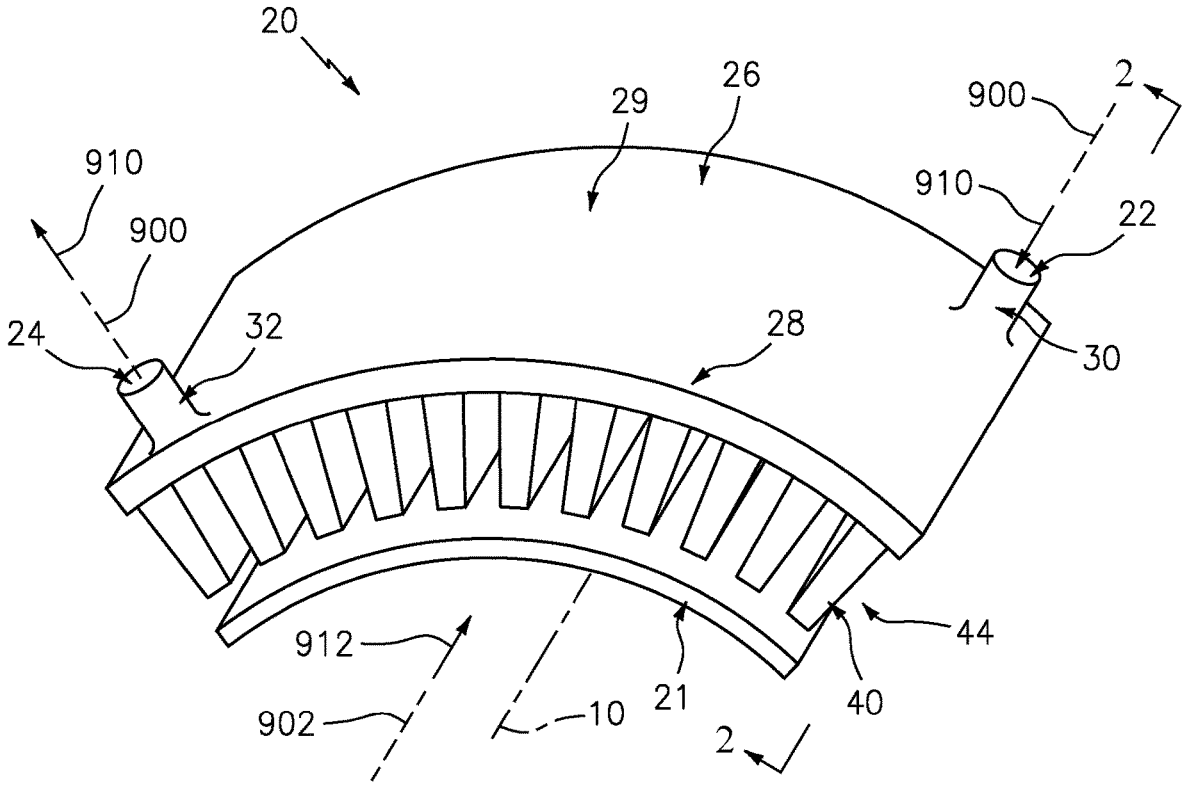
FIG. 1 is a schematic view of a heat exchanger.

FIG. 1 shows a gas turbine engine heat exchanger 20 providing heat exchange between a first flowpath 900 and a second flowpath 902 and thus between their respective first and second fluid flows 910 and 912. In the exemplary embodiment, the flowpaths 900, 902 are gas flowpaths passing respective gas flows 910, 912. In the illustrated example, the first flow 910 enters the heat exchanger 20 as a single piped flow and exits as a single piped flow 910; whereas the flow 912 is sector portion of an axial annular flow surrounding a central longitudinal axis (centerline) 10 of the heat exchanger and associated engine. For purposes of schematic illustration, the exemplary heat exchanger 20 is shown shaped to occupy essentially one quarter of a 360° annulus surrounding an inner member 21 such as an engine core. There may be multiple such heat exchangers occupying the full annulus or one or more such heat exchangers occupying only a portion of the annulus.

Other connections are also possible. For example, a configuration with a single first flow inlet and branched first flow outlets is shown in U.S. Patent Application No. 62/957,091 (the '091 application), filed Jan. 3, 2020, and entitled "Aircraft Heat Exchanger Assembly", the disclosure of which is incorporated by reference herein in its entirety as if set forth at length.

The heat exchanger 20 has an inlet 22 and outlet 24 for the first flow. The exemplary inlet and outlet are, respectively, ports of an inlet manifold 26 (FIG. 2) and an outlet manifold 28 (discussed below) formed as portions of a single combined manifold unit 29 in the example. Exemplary manifolds are metallic (e.g., nickel-based superalloy). The inlet manifold and outlet manifold may each have a respective fitting 30, 32 providing the associated port 22, 24. As is discussed further below, the inlet manifold and outlet manifold are coupled to heat exchanger plates of one or more exemplary plate banks 40.

Each plate bank 40 comprises a circumferential array of plates 44 (discussed further below). In the exemplary banks, the plates extend axially and radially relative to the axis 10. Thus, the plates diverge from each other in the outward radial direction. Each plate has an inlet port 46 and an outlet port 48. Exemplary ports 46, 48 are mated to sockets in an inner diameter (ID) wall portion of the respective manifold). Each plate has one or more internal passageways between the ports 46 and 48.

Figure 2:
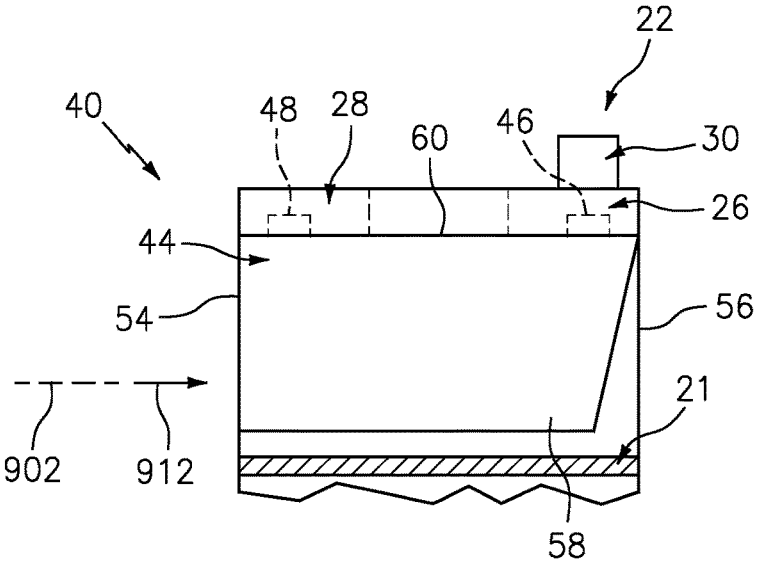
FIG. 2 is an axial side schematic view of the heat exchanger of FIG. 1.
Figure 3:
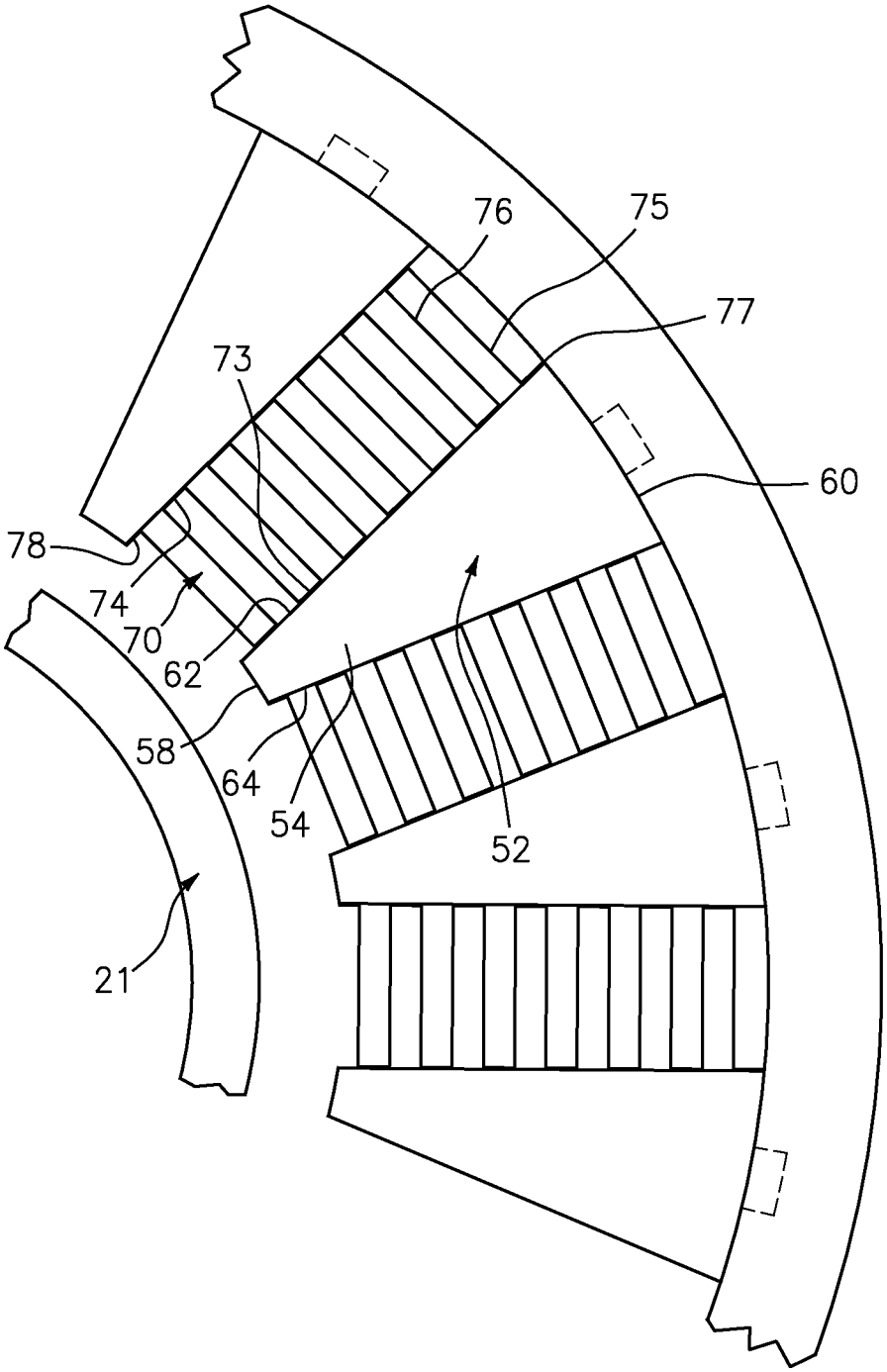
FIG. 3 is a schematic partial front view of the heat exchanger.
Figure 4:
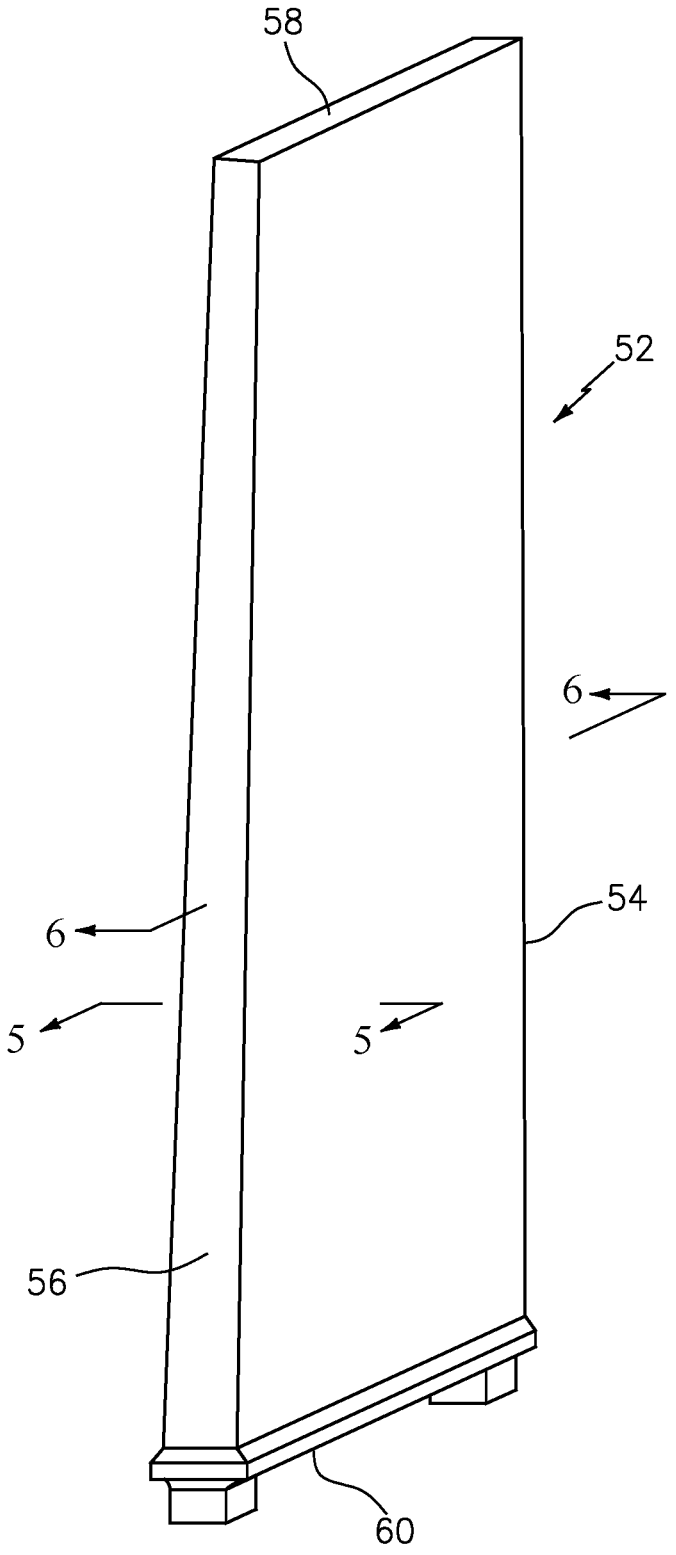
FIG. 4 is a view of a substrate of a plate of the heat exchanger.

Each plate 44 comprises a body or substrate 52 (FIG. 4—e.g., cast or additively manufactured alloy such as nickel-based superalloy) having a leading edge 54 (FIG. 2), a trailing edge 56, a distal edge (an inboard or inner diameter (ID) edge in the FIG. 2 heat exchanger) 58, a proximal edge (an outboard or outer diameter (OD) edge in the FIG. 2 heat exchanger) 60, a first lateral (circumferential (generally circumferentially facing) in the FIG. 2 heat exchanger) face 62 (FIG. 3) and a second lateral face 64.

As is discussed further below, the exemplary plates are essentially cantilevered from the manifold (lacking rigid coupling to static structure at the distal edges such as by having the distal edges free or not sufficiently rigidly coupled) and are thus subject to vibratory stimulus and resonance. To increase stiffness to combat resonance (e.g., by raising the natural frequency), the faces 62 and 64 may converge from the proximal edge 60 (the outer diameter edge in the illustrated orientation) toward the distal edge 58 (the ID edge in this example).

As is discussed below, one or both faces 62, 64 may bear fin arrays 70. The fins are separately formed (e.g., of folded sheetmetal—e.g., nickel-based superalloy) and secured (e.g., brazing, welding, diffusion bonding, and the like) to adjacent substrate(s) (generally see the '740 patent). As is discussed further below, exemplary fins are initially formed as square wave corrugations 72 (FIG. 3) of even height/amplitude whose troughs 73 or peaks 74 are secured to the associated face 62, 64. The corrugation has legs 75, 76 and extends from a first sectional end 77 (an outer diameter (OD) end in the example) to a second sectional end 78 (an inner diameter (ID) end in the example). Along the direction of the individual corrugations (streamwise of the ultimate second flow 912) the corrugation has a first end near the plate substrate upstream edge and a second end near the plate substrate downstream edge. In general, the term "plate" or "panel" may be applied at any of several levels of detail. It may identify a body or substrate of an assembly or the greater assembly or subassembly (e.g., a cast substrate plus one or more separately-attached fin arrays).

Figure 5:
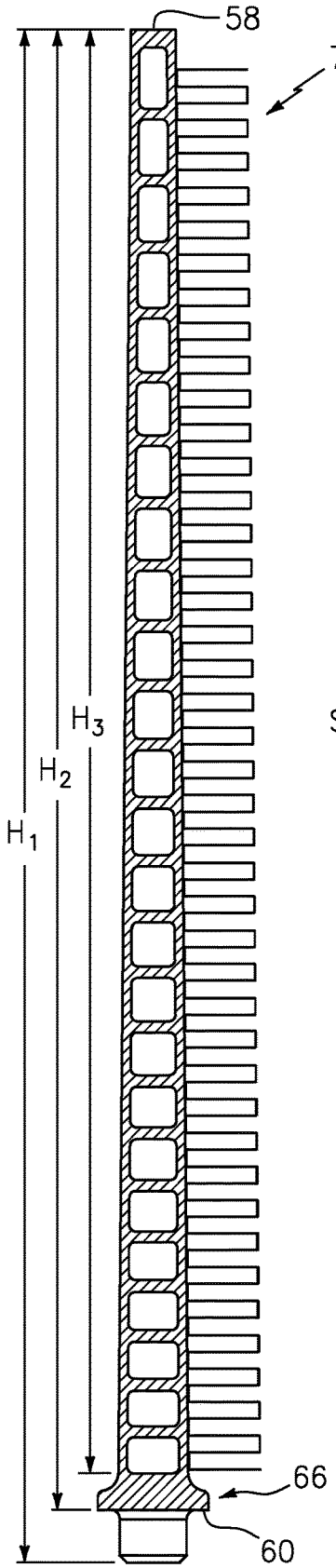
FIG. 5 is a transverse sectional view of the plate of the heat exchanger taken along line 5-5 in FIG. 4.

FIG. 5 shows the plate having an overall radial height $H_1$ and an exposed height $H_2$ (which ignores the height of any inlet or outlet fitting portion embedded/received in the manifold). Additionally, at the proximal edge, the plate has a flange 66. A height above the flange is $H_3$. Along a majority of these heights, the faces 62, 64 converge toward each other from the proximal edge 60 to the distal edge 58. An exemplary convergence angle $\theta_1$ is between 0.10° and 8.0°, more particularly, 0.25° and 5.0° or 0.25° and 2.0° or 0.50° and 2.0°. For plates mounted on a concave circular-section surface $\theta_1$ may be exactly equal to the circumferential angular on-center pitch of the plates or within a very small margin such as 0.05° to provide effective parallelism of adjacent plates. Depending on the diameter of the annulus being filled and the desired linear pitch, this angle can vary widely. That is, it may be more a result of geometry constraints than of tuning requirements. In exemplary embodiments, the angle $\theta_1$ may be in such range over a large fraction of one or more of such heights $H_1$, $H_2$, and $H_3$ (e.g., at least 40% or at least 50% or at least 60% or at least 70% or at least 80% or at least 90%). $\theta_1$ may be uniform along such range (e.g. an embodiment with a higher angle proximal portion being discussed below).

Figure 5A:
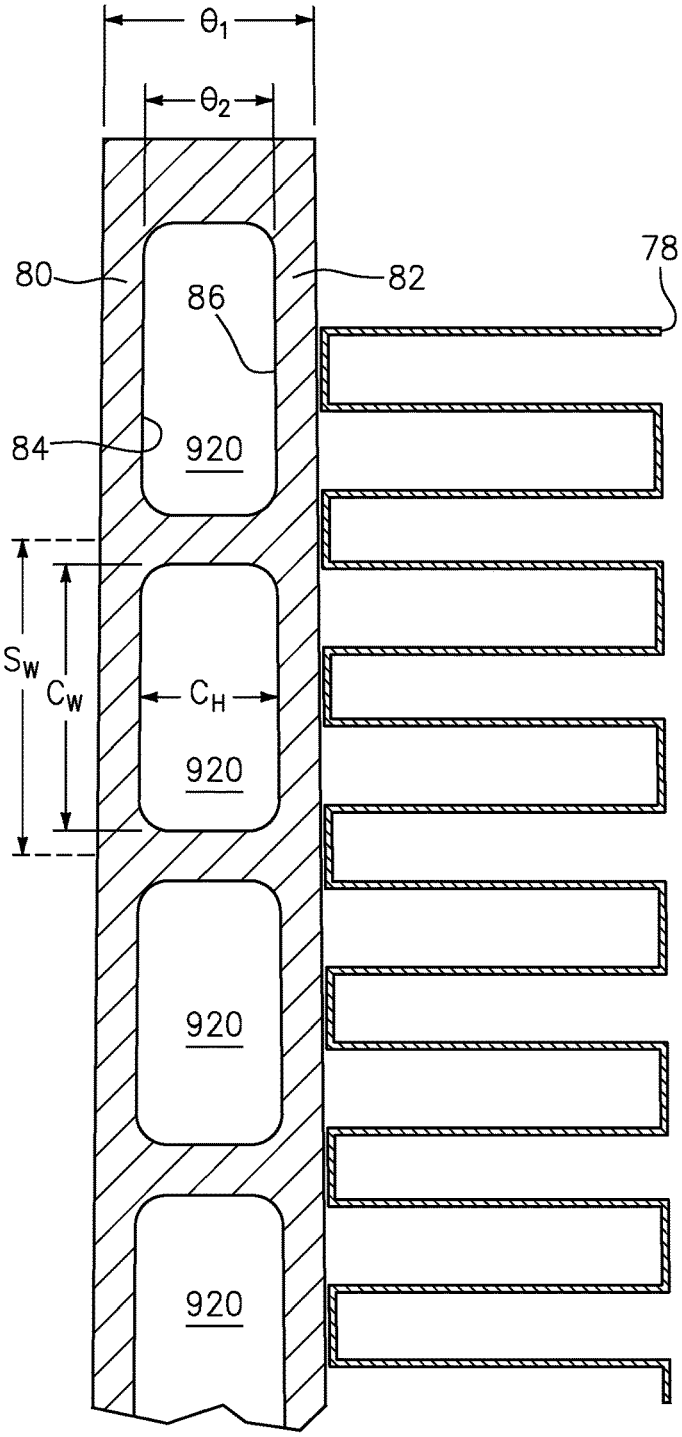
FIG. 5A is an enlarged view of a distal edge portion of the plate.

The interior passageways also generally converge in the proximal-to-distal direction. FIG. 5 shows such convergence at an angle $\theta_2$. In the FIG. 5 embodiment, $\theta_2$ is equal to $\theta_1$ so that sidewalls 80, 82 are effectively of uniform thickness. Respective sidewalls 80, 82 have inner surfaces 84 and 86. Exemplary $\theta_1$ and $\theta_2$ are 1.0°, more broadly 0.5° to 3.5° or 0.5° to 2.5°). FIG. 5A also identifies the cross-sectional width $C_W$ and the cross-sectional height $C_H$ of the passage leg 920. These features are further discussed below.

Figure 6:
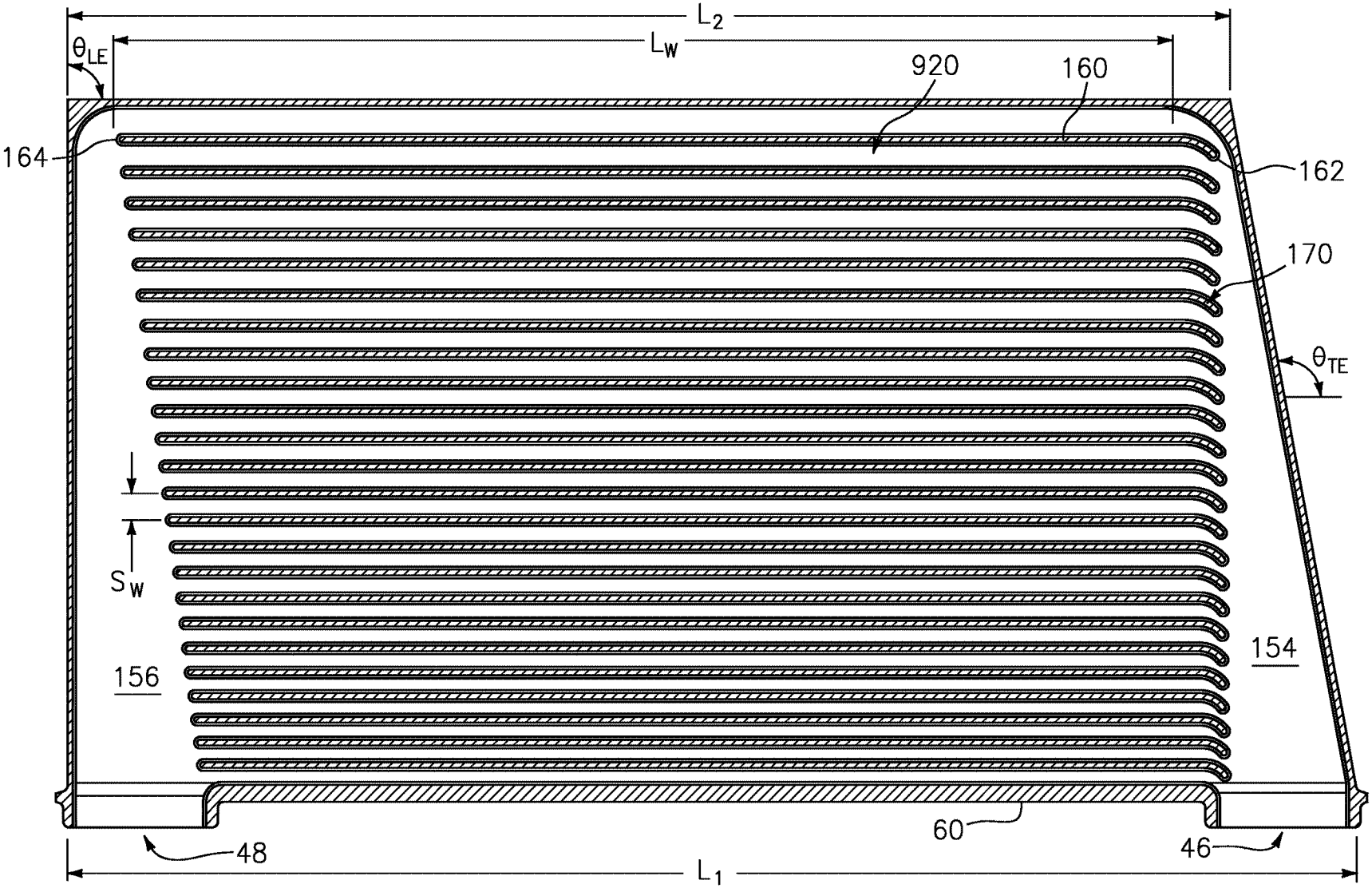
FIG. 6 is a longitudinal sectional view of the plate taken along line 6-6 in FIG. 4.

FIG. 6 shows each plate having an interior providing an associated flowpath branch/leg from the inlet 46 of the plate to the outlet 48. The exemplary inlets and outlets are along the proximal edge 60 (e.g., on plugs protruding from a flat main portion of the proximal edge and received in the respective manifold ports). The inlet 46 feeds an inlet plenum 154 adjacent/along the trailing edge while the outlet 48 is fed by a plenum 156 along the leading edge.

A generally radial array of passageway/flowpath legs (sublegs) 920 extend between the inlet plenum 154 and outlet plenum 156. The adjacent flowpath legs 920 are separated from each other by wall structures 160. Each wall structure 160 extends from a leading end 162 to a trailing end 164 (along the first flowpath). The exemplary wall structures 160 are straight with the exception of guide turns 170 extending a short distance from the leading edge 162 to guide air from a generally radially outward flow within the plenum 154 and shift that air generally axially. Although the outlet plenum 156 may have similar turns, modeling shows these to be less advantageous at the outlet plenum. The wall structures 160 span between adjacent interior faces 84, 86 (FIG. 5A).

The wall structures 160 may divide internal flows into smaller passages, thereby increasing surface area, more equally distributing, and/or accelerating internal flows. They may also tie the walls 80, 82 of the plate together to prevent ballooning under elevated temperatures and pressures.

The exemplary inlet plenum 154 converges in axial dimension from proximal to distal or downstream along the first flowpath. Similarly, the exemplary outlet plenum 156 diverges in axial dimension from distal to proximal or downstream along the first flowpath toward the outlet 48. Such respective convergence and divergence may reduce internal losses and prevents separation of flow.

FIG. 6 also shows several other geometric considerations. Wall 160 straight portion length $L_W$ and on-center spacing $S_W$ are shown. An angle $\theta_{LE}$ of the leading edge relative to the downstream direction and an angle $\theta_{TE}$ of the trailing edge relative to the downstream direction are shown. Plate root length $L_1$ and plate tip length $L_2$ are shown.

The interior of the plate may optionally include integral surface enhancement features (not shown—see the '091 application).

A uniform pitch or spacing $S_W$ of adjacent passages 920 will result in uniform surface areas for heat transfer (assuming uniform width dividing walls 160). However, this will cause larger flow areas near the proximal edge (counterproductive for flow distribution as discussed in the '091 application). More desirable is something closer to a uniform flow area through adjacent passages. This will result in a smaller spacing $S_W$ near the proximal edge relative to the larger spacing $S_W$ at the distal edge (e.g., a continuous progressive increase). Relative to a uniform spacing, this further raises the natural frequency of the plate by stiffening the proximal portion of the plate and/or lightening the distal portion of the plate.

One aspect of the convergence of the faces 62 and 64 is that the angle $\theta_1$ may be chosen, in view of the radius of curvature of the inner diameter surface of the manifold structure and circumferential on-center spacing of the plates so that each face 62 is parallel to the adjacent face 64 of the next adjacent plate (if any) and vice versa. This parallelism allows the constant amplitude wave fin structure to be used to span the gap between adjacent plate substrates with peaks secured to one substrate and troughs secured to the other.

When parallelism is not a consideration, other angle variations are possible such as having a continuously varying angle (e.g., a slight concavity in the faces 62, 64). Additionally, other fin structures may be included including free-ended fins cut from such wave form stock. For example, a configuration with wire electrodischarge machined (EDM) fins is shown in U.S. Patent Application No. 62/963,068 (the '068 application), filed Jan. 19, 2020, and entitled "Aircraft Heat Exchanger Finned Plate Manufacture", the disclosure of which is incorporated by reference herein in its entirety as if set forth at length.

Figure 7:
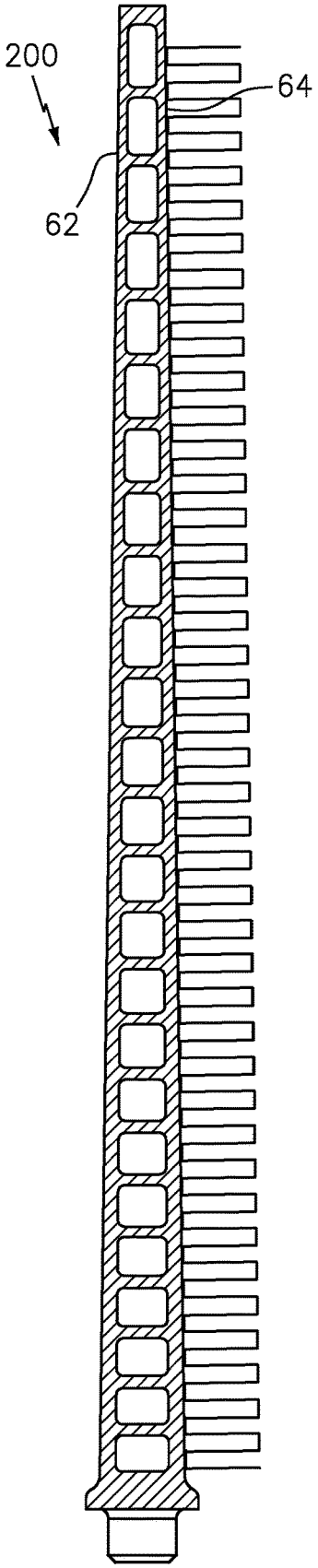
FIG. 7 is a transverse sectional view of a first alternative plate of the heat exchanger.
Figure 7A:
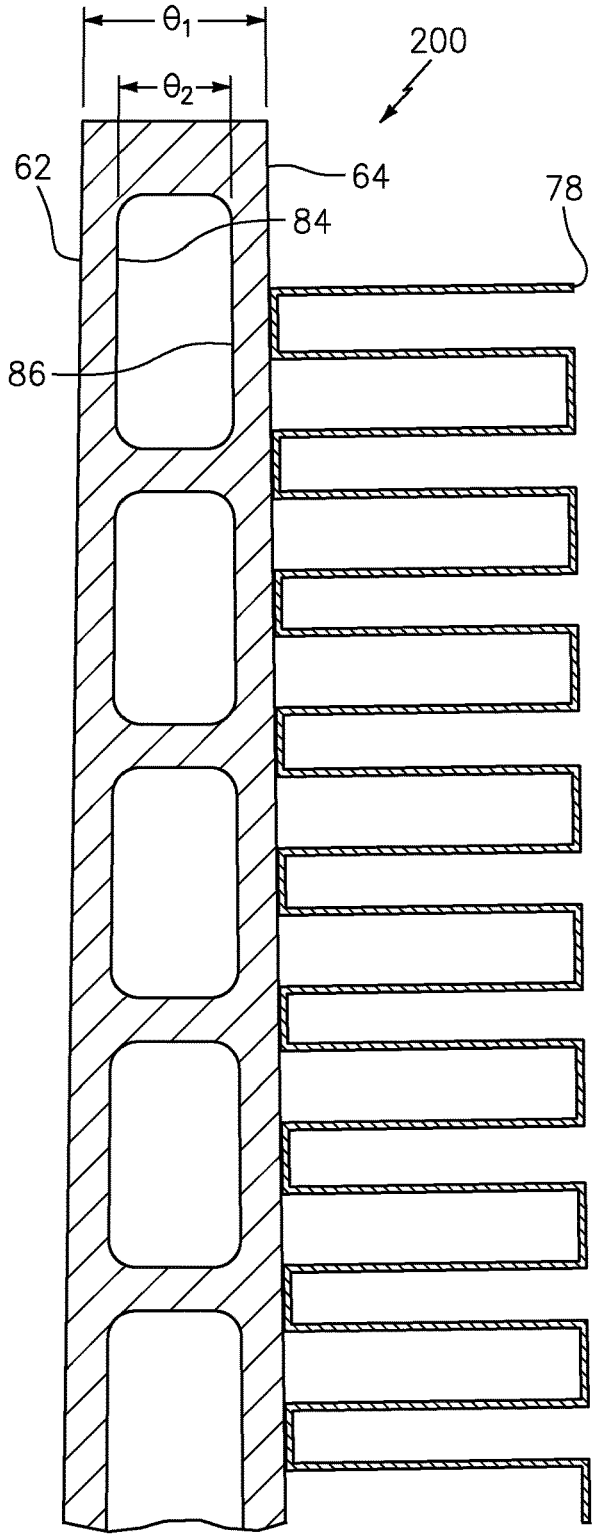
FIG. 7A is an enlarged view of a distal edge portion of the first alternative plate.

FIG. 7 shows a further plate 200 otherwise similar to the plate 44 except that the interior faces 84 and 86 taper somewhat less than the taper of the faces 62 and 64 ($\theta_1 > \theta_2$) (exemplary $\theta_1$ 1.5° and $\theta_2$ 1.0°) so that the wall thickness generally decreases in the proximal-to-distal direction. Otherwise, $\theta_1$ and other considerations may be similar to that of the plate 44. Exemplary $\theta_1$ is at least 0.25° greater than $\theta_2$, more generally 0.25° to 3.0° or 0.30° to 1.5° with an example of 0.50°. This also highlights that, even where $\theta_1$ is constant, adjacent $\theta_2$ need not be.

Figure 8:
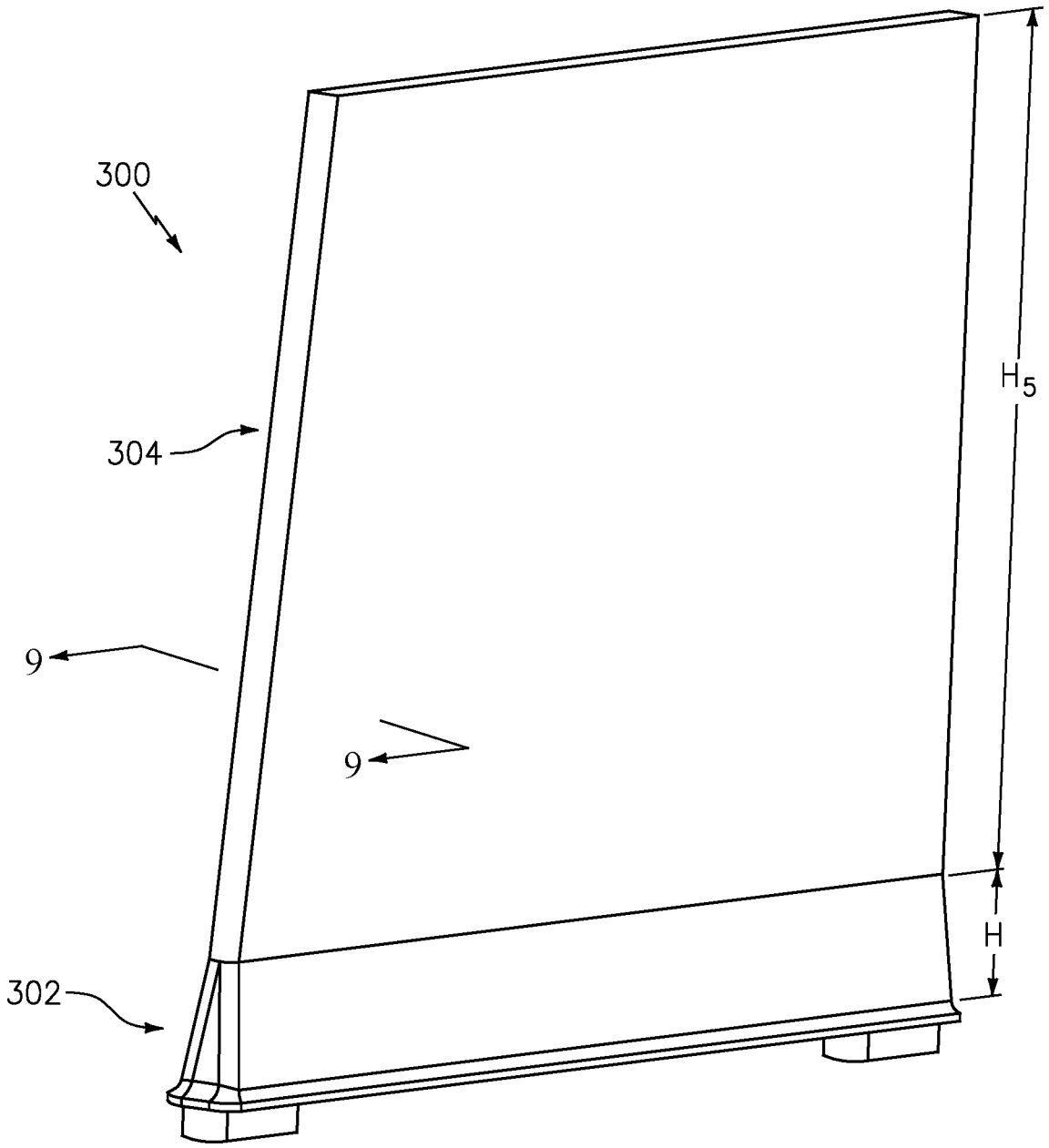
FIG. 8 is a view of a substrate of a plate of a second alternative plate.
Figure 9:
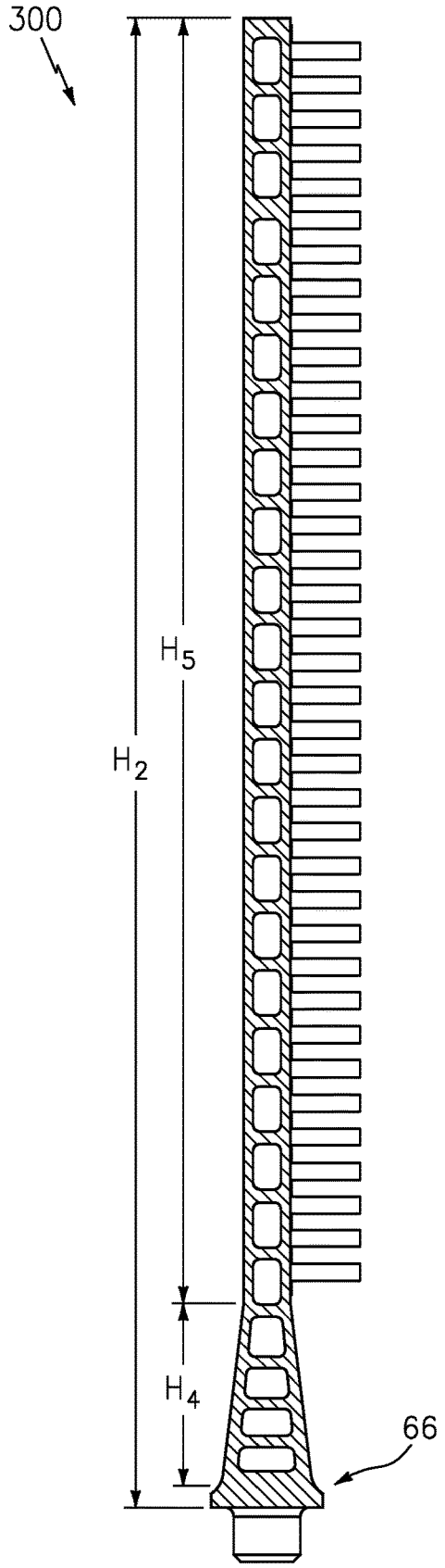
FIG. 9 is a transverse sectional view of the second alternative plate taken along line 9-9.
Figure 9A:
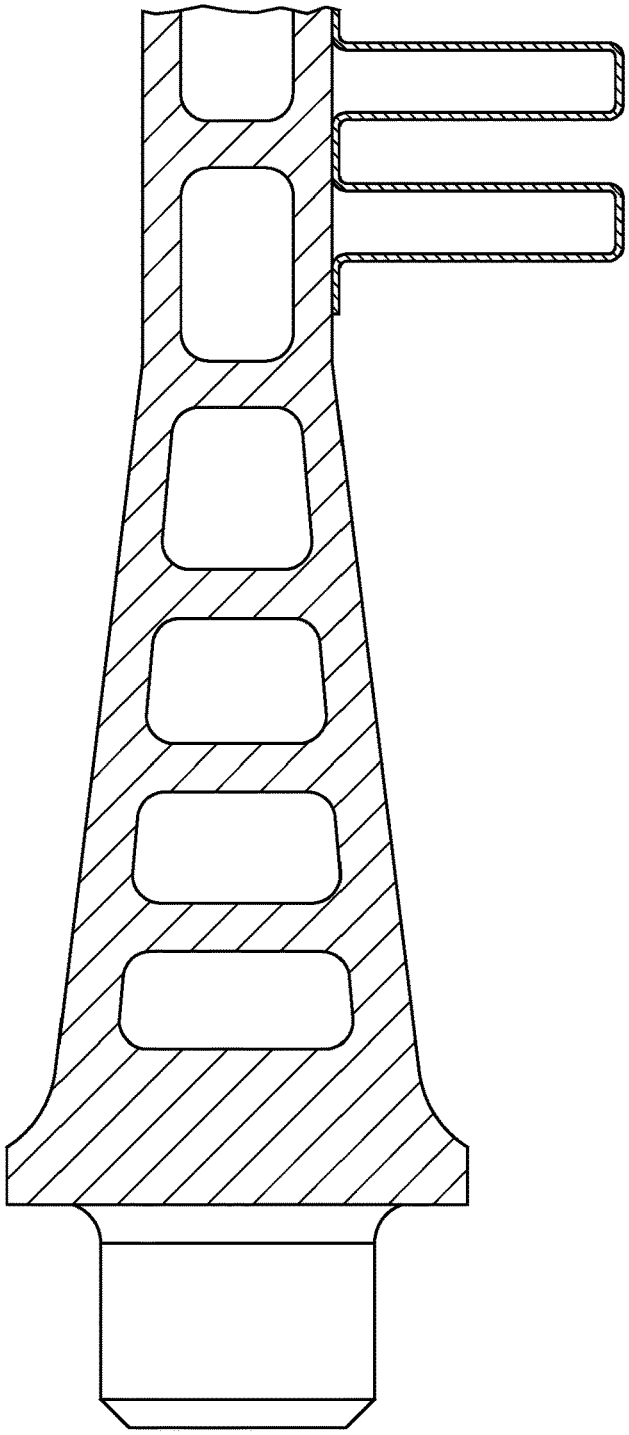
FIG. 9A is an enlarged view of a proximal edge portion of the second alternative plate.

FIGS. 8 and 9 show an alternate configuration of a plate 300 in which a base/proximal portion 302 (height $H_4$ measured from the distal end of the flange 66) of the substrate rapidly tapers but transitions to a distal portion 304 (height $H_5$) that is less tapering. Exemplary $H_4$ is 5.0% to 50.0% of $H_2$ (but the upper end of that range could go to 100%), more particularly 8.0% to 20.0% or 10.0% to 15.0%. FIG. Along that proximal portion 302, exemplary $\theta_1$ is 1.0° to 30.0°, more particularly, 5.0° to 20.0° or 10.0° to 18.0°. In the exemplary embodiment, the distal portion 304 does not taper at all Alternative distal portions 304 may taper in similar fashion to the embodiments above.

Figure 11:
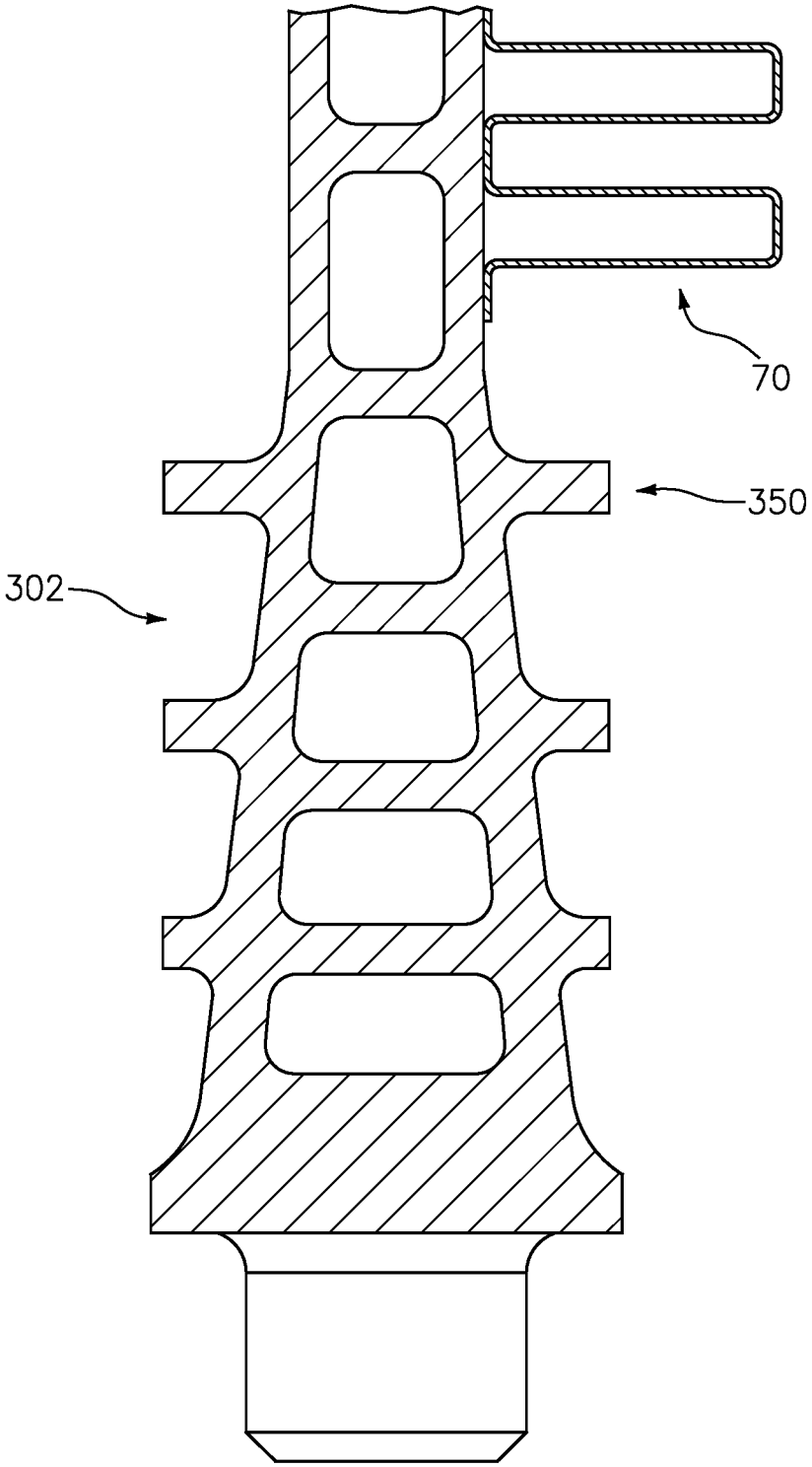
FIG. 11 is an enlarged view of a proximal edge portion of a third alternative plate.

A particular situation wherein such plates 300 may be particularly useful is with a flat manifold wherein the adjacent faces of two plates along the distal portion 304 are parallel and may feature a wave-form fin structure joining the two as discussed above. The proximal portion 302 may still provide stiffness/resonance benefits. FIG. 11 is another example of one such situation. Because the fins do not extend to the proximal sections, the proximal sections themselves may bear integral fins 350 and may bear chevron or other trip strips (not shown).

Figure 10:
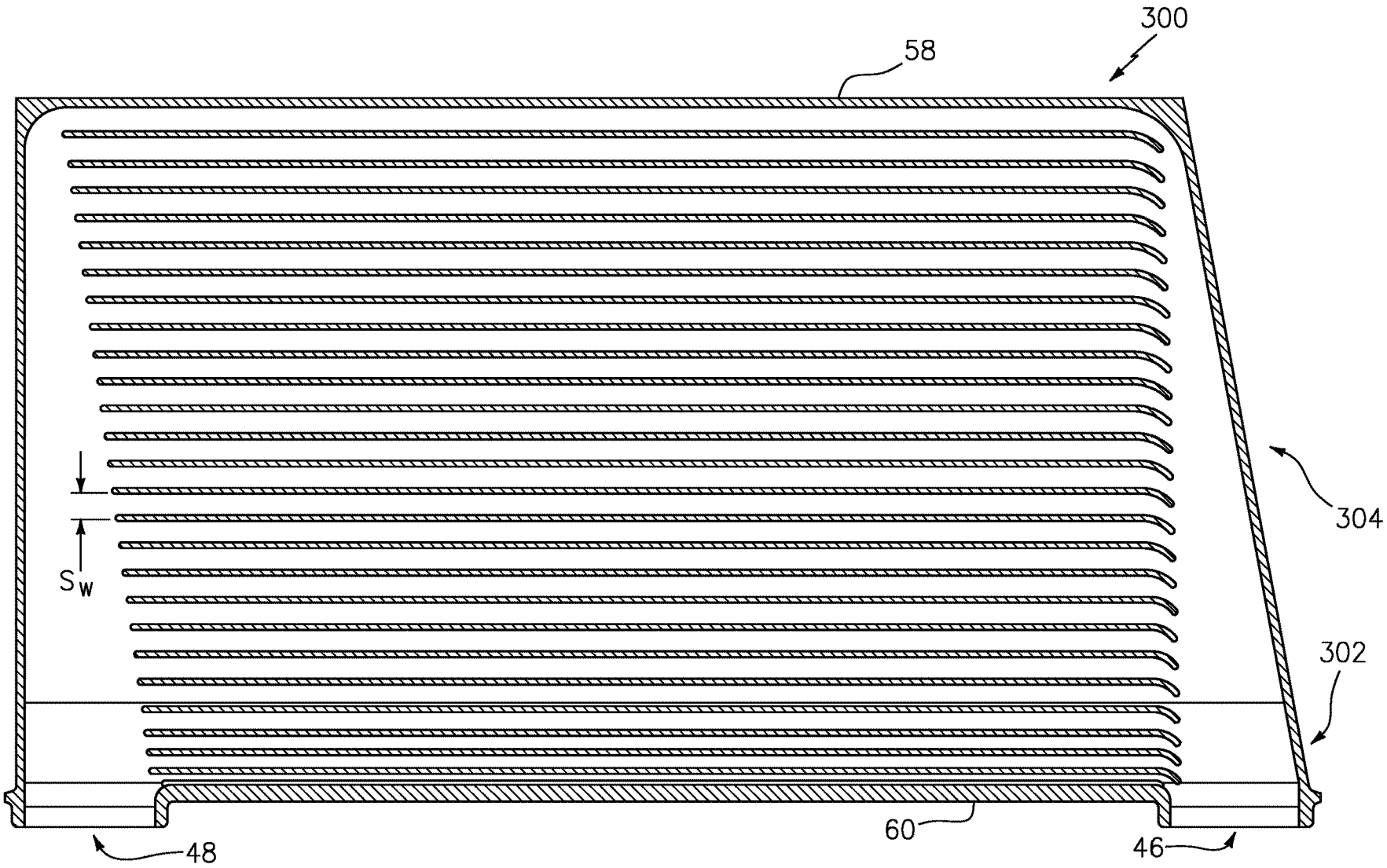
FIG. 10 is a longitudinal sectional view of the second alternative plate taken along line 10-10 in FIG. 8.

In the FIG. 10 example, of interior passages, passage cross-sectional areas are the same as each other due to a progressive net 40% reduction in spacing $S_W$ from the fifth passage (standard size shared with remaining passages distally thereof) to the first passage (smallest—near the proximal edge). The same stiffening benefit discussed above applies.

Figure 12:
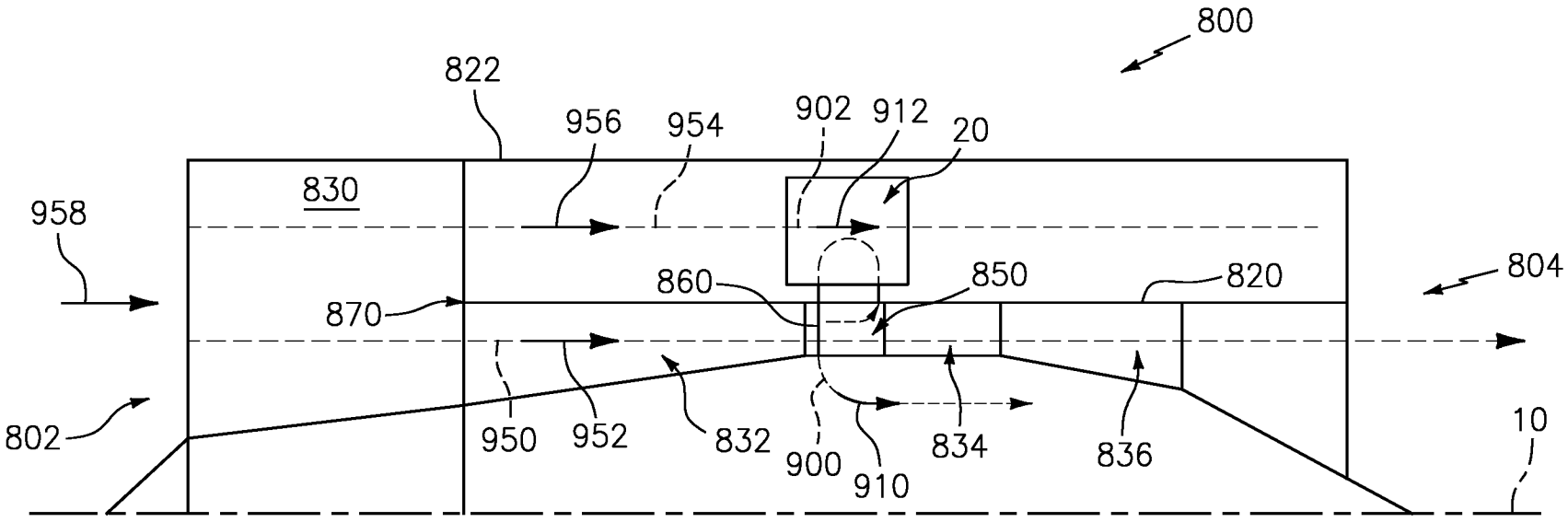
FIG. 12 is a schematic axial half section view of a gas turbine engine including the heat exchanger.

FIG. 12 schematically shows a gas turbine engine 800 as a turbofan engine having a centerline or central longitudinal axis 10 and extending from an upstream end at an inlet 802 to a downstream end at an outlet 804. The exemplary engine schematically includes a core flowpath 950 passing a core flow 952 and a bypass flowpath 954 passing a bypass flow 956. The core flow and bypass flow are initially formed by respective portions of a combined inlet airflow 958 divided at a splitter 870.

A core case or other structure 820 divides the core flowpath from the bypass flowpath. The bypass flowpath is, in turn, surrounded by an outer case 822 which, depending upon implementation, may be a fan case. From upstream to downstream, the engine includes a fan section 830 having one or more fan blade stages, a compressor 832 having one or more sections each having one or more blade stages, a combustor 834 (e.g., annular, can-type, or reverse flow), and a turbine 836 again having one or more sections each having one or more blade stages. For example, many so-called two-spool engines have two compressor sections and two turbine sections with each turbine section driving a respective associated compressor section and a lower pressure downstream turbine section also driving the fan (optionally via a gear reduction). Yet other arrangements are possible.

FIG. 12 shows the heat exchanger 20 positioned in the bypass flowpath so that a portion of the bypass flowpath 954 becomes the second flowpath 902 and a portion of the bypass flow 956 becomes the second airflow 912.

The exemplary first airflow 910 is drawn as a compressed bleed flow from a diffuser case 850 between the compressor 832 and combustor 834 and returned radially inwardly back through the core flowpath 950 via struts 860. Thus, the flowpath 900 is a bleed flowpath branching from the core flowpath.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A heat exchanger plate for providing heat transfer between a first flow along a first flowpath and a second flow along a second flowpath, the heat exchanger plate comprising a body having:

a leading edge along the second flowpath and a trailing edge along the second flowpath;

a first face along the second flowpath and a second face opposite the first face along the second flowpath, the leading edge and the trailing edge joining the first face and second face;

a proximal edge having at least one inlet port along the first flowpath and at least one outlet port along the first flowpath; and at least one passageway along the first flowpath, wherein:

the body comprises a cast substrate;

along at least one of the first face and the second face the plate has sheetmetal fins secured to the body;

along at least 8.0% of a height between the proximal edge and the distal edge, the first face and the second face converge at a first angle of at least 0.25°.

2. The heat exchanger plate of claim 1 wherein:

said at least 8.0% of a height between the proximal edge and the distal edge is a continuous zone and the first angle is uniform along said continuous zone.

3. The heat exchanger plate of claim 1 wherein:

the plate has a plurality of interior walls separating legs of the at least one passageway at a progressively increasing spacing from proximal to distal.

4. The heat exchanger plate of claim 1 wherein:

along at least 50% of a height between the proximal edge and the distal edge, the first face and the second face converge at a first angle of between 0.25° and 5.0°.

5. The heat exchanger plate of claim 1 wherein the passageway comprises:

an inlet plenum extending from the at least one inlet port of the plate;

an outlet plenum extending to the at least one outlet port of the plate; and a plurality of legs in parallel between the inlet plenum and the outlet plenum.

6. The heat exchanger plate of claim 5 wherein:

the inlet plenum is adjacent the trailing edge; and the outlet plenum is adjacent the leading edge.

7. A heat exchanger plate for providing heat transfer between a first flow along a first flowpath and a second flow along a second flowpath, the heat exchanger plate comprising a body having:

a first face and a second face opposite the first face;

a leading edge along the second flowpath and a trailing edge along the second flowpath;

a proximal edge having at least one inlet port along the first flowpath and at least one outlet port along the first flowpath; and at least one passageway along the first flowpath, wherein:

along a proximal portion, the first face and the second face converge at a first angle;

along a distal portion, the first face and the second face converge at a second angle less than the first angle;

along the proximal portion, the body has integral fins; and along the distal portion, the plate has sheetmetal fins secured to the body.

8. The heat exchanger plate of claim 7 wherein:

the first angle is at least 0.25° greater than the second angle.

9. The heat exchanger plate of claim 7 wherein:

the second angle is 0.0°.

10. The heat exchanger plate of claim 7 wherein:

the proximal portion extends for a height of at least 8% of a height from the proximal edge.

11. The heat exchanger plate of claim 7 wherein:

along the proximal portion, the plate has a plurality of walls at a progressively increasing spacing from proximal to distal.

12. The heat exchanger plate of claim 11 wherein:

along the distal portion, the plate has a plurality of walls at a constant spacing.

13. The heat exchanger plate of claim 7 wherein the body comprises a cast substrate.

14. The heat exchanger plate of claim 7 wherein:

along the distal portion, the plate has sheetmetal fins secured to the body.

15. The heat exchanger plate of claim 7 wherein:

the at least one inlet port along the first flowpath is a single inlet port;

the at least one outlet port along the first flowpath is a single outlet port; and the single inlet port and single outlet port are on respective plugs.

16. The heat exchanger plate of claim 7 wherein:

the at least one inlet port along the first flowpath is a single inlet port;

the at least one outlet port along the first flowpath is a single outlet port; and the single inlet port and single outlet port are on respective plugs protruding from a flat main portion of the proximal edge.

17. The heat exchanger plate of claim 1 wherein:

the at least one inlet port along the first flowpath is a single inlet port;

the at least one outlet port along the first flowpath is a single outlet port; and the single inlet port and single outlet port are on respective plugs.

18. The heat exchanger plate of claim 1 wherein:

the at least one inlet port along the first flowpath is a single inlet port;

the at least one outlet port along the first flowpath is a single outlet port; and the single inlet port and single outlet port are on respective plugs protruding from a flat main portion of the proximal edge.

19. A heat exchanger plate for providing heat transfer between a first flow along a first flowpath and a second flow along a second flowpath, the heat exchanger plate comprising a body having:

a first face and a second face opposite the first face;

a leading edge along the second flowpath and a trailing edge along the second flowpath;

a proximal edge having at least one inlet port along the first flowpath and at least one outlet port along the first flowpath; and at least one passageway along the first flowpath, wherein:

along a proximal portion, the first face and the second face converge at a first angle;

along a distal portion, the first face and the second face converge at a second angle less than the first angle;

along the proximal portion, the plate has a plurality of walls at a progressively increasing spacing from proximal to distal; and along the distal portion, the plate has a plurality of walls at a constant spacing.

20. The heat exchanger plate of claim 19 wherein:

the body comprises a cast substrate;

along the distal portion, the plate has sheetmetal fins secured to the body, the at least one inlet port along the first flowpath is a single inlet port;

the at least one outlet port along the first flowpath is a single outlet port; and the single inlet port and single outlet port are on respective plugs protruding from a flat main portion of the proximal edge.

* * * * *